US005295548A

United States Patent [19]

Yuasa et al.

[11] Patent Number: 5,295,548

[45] Date of Patent: Mar. 22, 1994

[54] BOTTOM-HOLE INFORMATION COLLECTING EQUIPMENT

[75] Inventors: Hajime Yuasa; Kazuho Hosono, both of Akishima, Japan

[73] Assignee: Akishima Laboratories(Mitsui Zosen) Inc., Tokyo, Japan

[21] Appl. No.: 966,113

[22] Filed: Oct. 23, 1992

[30] Foreign Application Priority Data

Oct. 25, 1991 [JP] Japan ..... 3-307037

[51] Int. Cl.[5] ..... E21B 49/00

[52] U.S. Cl. ..... 175/40

[58] Field of Search ..... 175/40, 46, 48, 50

[56] References Cited

U.S. PATENT DOCUMENTS

| | | | |
|---|---|---|---|
| 4,790,380 | 12/1988 | Ireland et al. | 166/250 |
| 4,802,143 | 1/1989 | Smith | 175/40 |
| 4,901,069 | 2/1990 | Veneruso | 175/40 X |
| 4,936,139 | 6/1990 | Zimmerman et al. | 175/40 X |
| 4,955,438 | 9/1990 | Juergens et al. | 175/40 |

FOREIGN PATENT DOCUMENTS

| | | |
|---|---|---|
| 0145537 | 6/1985 | European Pat. Off. . |
| 0323773 | 7/1989 | European Pat. Off. . |
| 2084224 | 4/1982 | United Kingdom . |
| 81/03382 | 11/1981 | World Int. Prop. O. . |

*Primary Examiner*—Thuy M. Bui

*Attorney, Agent, or Firm*—Flynn, Thiel, Boutell & Tanis

[57] ABSTRACT

A bottom-hole information collecting equipment to collect data at the bottom part of the shaft in real time by the sonde throughout an excavation by the bit for digging. The sonde is provided to be mechanically and electronically connected to or separated from the connecting pipe to which the bite is attached arbitrarily. Data collected by several sensors near the bit is transmitted to the sonde via the electromagnetic coupler. The electricity for the sensors and the sonde can be obtained by respective generators of which one is in the sonde and the other is in the connecting pipe.

11 Claims, 5 Drawing Sheets

BOTTOM-HOLE INFORMATION COLLECTING EQUIPMENT

BACKGROUND OF THE INVENTION

1. FIELD OF THE INVENTION

The present invention is related to the bottom-hole information collecting equipment and is applicable to collect data at the bottom part of the shaft for building petroleum wells, geothermal wells or gas wells and for the investigations of earthquake or geology.

2. DESCRIPTION OF THE RELATED ART

A shaft has been formed by digging the ground to build petroleum wells, geothermal wells or gas wells and to investigate earthquake and geology.

For digging such a shaft, a plurality of cylindrical digging pipes which are connected to each other and provided with a bit at its forwarded end are used. The waste pieces of rocks and soil because of digging are discharged by the muddy water which is continuously fed into the inside of the digging pipes from its one end near the earth surface. This muddy water going down toward the bottom-hole of the shaft through the inside of the digging pipes spouts out from the bit toward the bottom-hole of the shaft and thereafter returns to the earth surface passing between the outer side of the digging pipes and the inner side of the shaft. The thus-returned muddy water can carry or take out pieces of rock and soil which are unnecessary for digging more. In the case of the bottom-hole reaching at the depth of 5000 m below the ground, the temperature and pressure of the muddy water become very high affected by the geothermy and the depth of the underground.

It is required for such an equipment to detect the data of torque given to the bit under excavation and the data such as load to be collected in real time. For collecting the data, several sensors are mounted inside the digging pipes near the bit. A main part of the conventional bottom-hole information collecting equipment to collect such data gotten by these sensors should be provided inside of the forwarded end part of the digging pipes. The casing which covers the main part of the bottom-hole information collecting equipment inevitably required to be highly sealed up to function in the muddy water being at the above-mentioned high temperature and under high pressure. To secure the high sealing and the electric connection to the sensor, the digging pipe where the main part of the bottom-hole information collecting equipment and the sensors are kept thereinside is firmly connected to other digging pipes extending from the ground.

However, as the main part of the bottom-hole information collecting equipment can not be separated from the digging pipes according to the conventional structure, even if the temperature at the bottom-hole of the shaft becomes high, it is impossible to collect only the bottom-hole information collecting equipment to the ground in order to prevent breakdown. Hence, the concerned equipment is damaged by the heat during the long-time work and thrown away after use.

Another type of the bottom-hole information collecting equipment which is capable of being separated from the digging pipes has been invented, but it was difficult to be electrically connected with the bit torque and the load sensor which are necessary to be provided near the bit in the muddy water at high temperature and under high pressure. Thus, such a system as to read out necessary data after recording again was forced. Neither the conventional bottom-hole information collecting equipments mentioned above could collect the data of torque and load given to the bit under excavation in real time.

The present invention aims to collect the data of digging pipe in real time and to provide a bottom-hole information collecting equipment which can be connected to or separated from the digging pipe arbitrarily.

SUMMARY OF THE INVENTION

The present invention is a bottom-hole information collecting equipment to collect the data at the bottom of the shaft under excavation by using a sonde provided inside a digging pipes. The sonde can be mechanically attached to or separated from the digging pipes and are also electrically connected to the sensors through an electromagnetic coupler. Accordingly, the data of the digging pipes can be collected in real time under excavation. Besides, since the sonde and the sensor are connected by the electromagnetic coupler, there is no possibility that they touch each other directly.

Therefore, the electric joint formed between the sonde and the sensor inserted in the digging pipes can have a sealing structure which can stand the muddy water at high temperature and high pressure. The sealing structure enables the sonde and the sensor to be connected electrically in the muddy water at high temperature and high pressure, and it enables the sonde to be connected to or separated from the digging pipes. When it is expected that the temperature at the bottom-hole part becomes higher than the heat resistant limit of the sonde, by lifting it to the ground after separating it from the digging pipes, the sonde escapes from being damaged because of the high temperature, whereby the purpose of the present invention is achieved.

DETAILED DESCRIPTION OF THE PREFERRED EMBODIMENT(S)

One of the best mode embodiment based on the present invention is explained below referring to the attached drawings.

Figure 1:
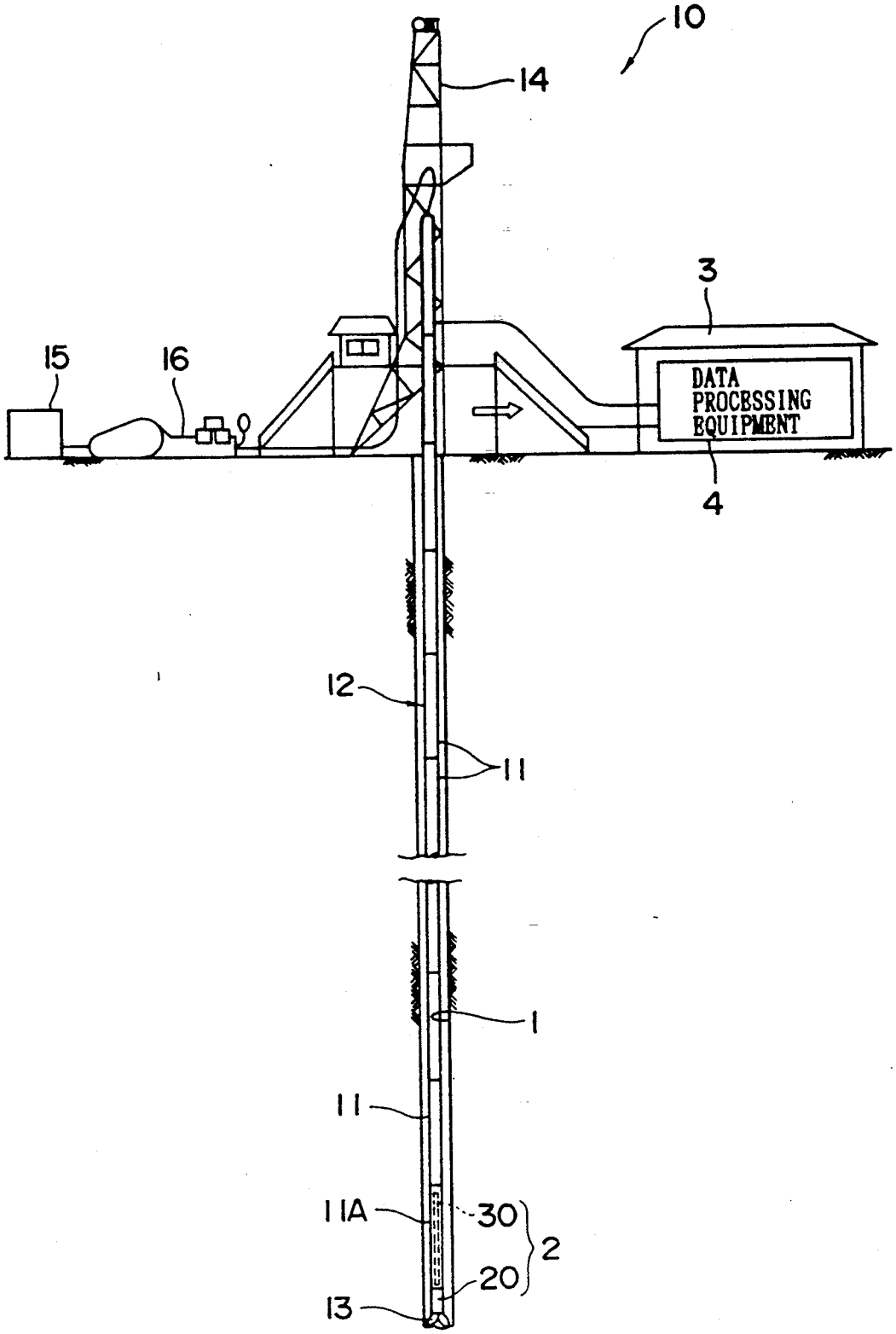
FIG. 1 is a side-view which shows the whole structure of the excavation equipment according to a preferable embodiment related to the present invention.

FIG. 1 shows the whole structure of the excavating equipment 10 according to the present embodiment. This excavating equipment 10 is equipped with a digging pipes 12 which more than one steel pipes 11 are connected to one another and a bit 13 which is attached to the forwarded end of the digging pipes 12. The excavation of the shaft 1 proceeds by the rotation of the bit 13 while the steel pipes 11 are added one after another.

The excavating equipment 10 also has a tower 14 for excavation, inside of which a winch to lift the digging pipes 12, an equipment to add or separate the digging pipes 12, and the driving equipment to rotate the digging pipes 12 are contained. In the left side of the tower 14 shown in FIG. 1, a muddy water tank 15 and a muddy water pump 16 whose delivery opening is connected to the upper end of the digging pipes 12, whereby the muddy water is forced inside the digging pipes 12. The forced muddy water carries pieces of rock and sand scraped by the bit 13 after spouting toward the bottom of the shaft 1 through an opening on the bit 13. Besides, the muddy water always has its ingredients arranged in the muddy water tank 15 to carry pieces of rock and sand scraped by the bit 13 to the ground.

A bottom-hole information collecting equipment 2 according to the present invention is provided to collect necessary information at the bottom of the shaft 1 by being mounted in the forwarded end of the digging pipes 12. The bottom-hole information collecting equipment 2 is an equipment to alter the collected data from the electric signal to the pressure signal of the muddy water and thereafter to send it to the ground. The bottom-hole information collecting equipment 2 has a connecting pipe 20 which contains several sensors and connects the digging pipes 12 to the bit 13 and a sonde 30 which collects the data from the sensor and sends it to the ground.

While a data processing equipment 4 is established inside an operation room 3 next to the tower 14 to control the data collected by the bottom-hole information collecting equipment 2. The data processing equipment 4 has a signal receiving set, which can receive the pressure signal of the muddy water which is transmitted through the muddy water after being issued from the bottom-hole information collecting equipment. The data processing equipment 4 can control the data indication and analysis concerning the bottom-hole of the shaft 1.

Figure 2:
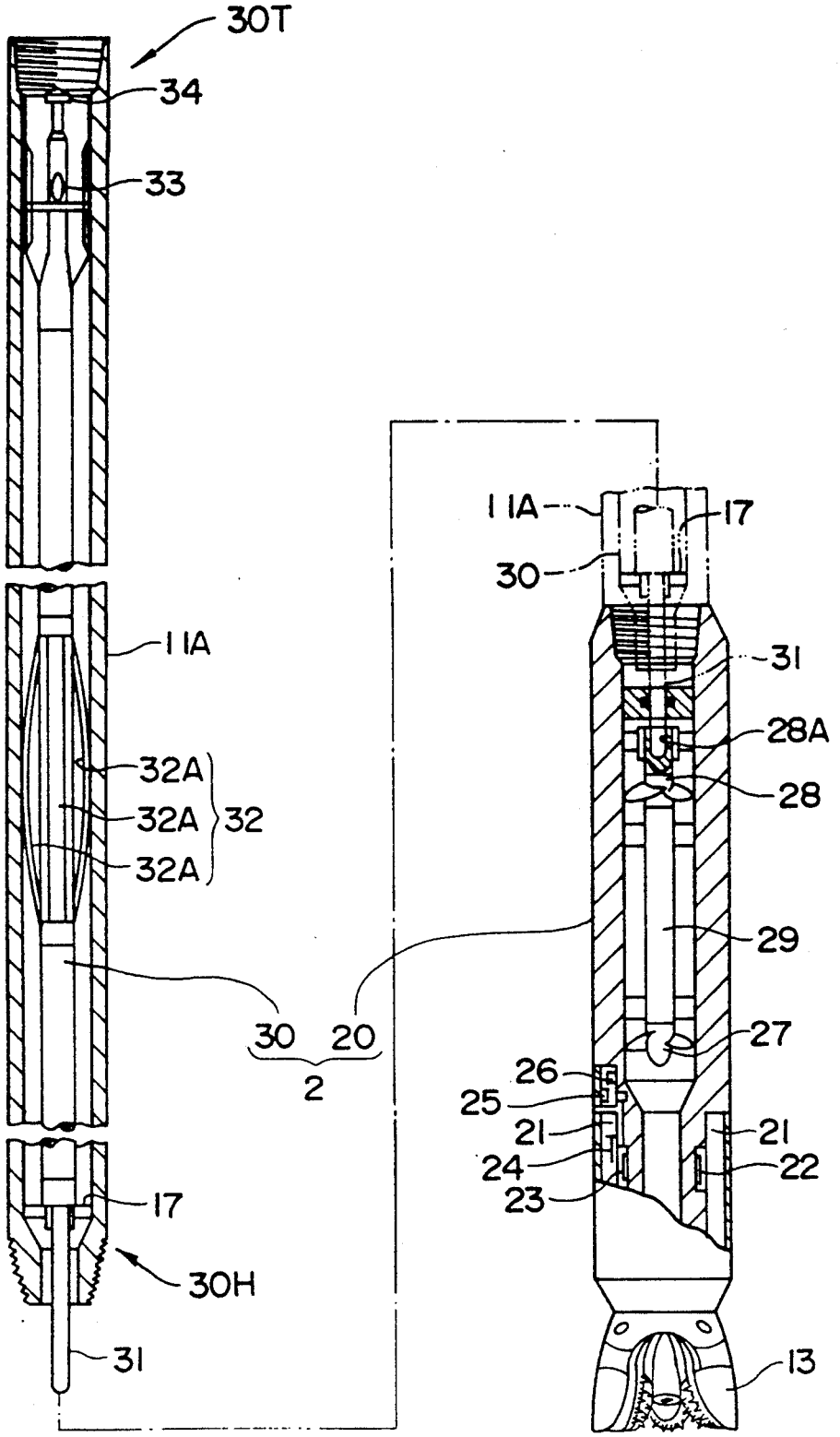
FIG. 2 is a sectional view which shows the bottom-hole information collecting equipment.

FIG. 2 is an enlarged view of the bottom-hole information collecting equipment 2 attached to the forwarded end of the digging pipes 12. As is shown in FIG. 2, the steel pipe 11A which contains the sonde 30 inside of it, the connecting pipe 20, and the bit 13 are connected to the end of the digging pipes 12 in this order. The steel pipe 11A has a supporting member 17 on its end, designated by 30H in FIG. 2, to maintain the sonde 30 inside.

The both ends in the axial directions of the connecting pipe 20 are formed into female screws, into which a male screw formed on the end of the steel pipe 11A and a male screw formed on the base end of the bit 13 are respectively screwed in, whereby the steel pipe 11A as one of the digging pipes 12 and the bit 13 are connected through the connecting pipe 20.

More than one cavities 21 are provided with the inside space of the side walls of the connecting pipe 20. In each cavity 21, a sensor 22 to detect the torque for the bit 13, a sensor 23 to detect the load, a sensor 24 to detect the temperature at the bottom part of the shaft 1 and a sensor 25 to detect the pressure are provided. An electric circuit part 26 with converters to change the analog signals gotten by the sensors 22–25 into digital signals is provided.

Inside the connecting pipe 20, two turbine blades 27 and 28 rotating according to the current of the muddy water fed by the muddy water pump 16 are mounted, the turbine blade 27 on the lower part in the plan has a role of driving a generator 29 which supplies electricity to a transmission circuit 60 and so on. The turbine blade 28 on the upper side in the plan is used for a generator which is not shown but is preferably built in the lower part 30H of the sonde 30 to secure the electric power required by the sonde 30, especially by a receiving circuit 70. The abbreviated generator for the sonde 30 can be driven by the turbine blade 28 via a shaft 31 which is coupled into a hollow 28A on the same axis of the central axis in the turbine blade 28.

The sonde 30 has a round bar shape which is a little thinner than the inner diameter of the digging pipes 12 (the steel pipe 11A) to secure its arrival at the bottom part of the shaft 1 by its weight in a case of being thrown into the digging pipes 12 from the ground and free flow of the muddy water between the inside of the digging pipes 12 and the sonde 30. Therefore, the head of the sonde 30 has the shaft 31 with smaller diameter thereof with the same axis to rotate freely. The end of the shaft 31 is securely inserted into the hollow 28A of the turbine blade 28 mounted inside the connecting pipe 20.

The sonde 30 has four plate spring bent into an arch adjusted to the length direction at the interval of right angle on the outer circumference. The central part of each plate spring 32A is kept in touch with the inside of the steel pipe 11A, whereby the central axis of the sonde 30 is aligned to the central axis of the steels 11 and 11A. In the explanation below, the combination of the four plate springs is called a centralizer 32. By the function of the centralizer 32, the shaft 31 of sonde 30 which reaches the bottom of the shaft 1 by free fall automatically gets into the hollow 28A of the connecting pipe 20. If the shaft 31 fits into the hollow 28A, the connection between the connecting pipe 20 where the bit 13 is attached and the sonde 30 is completed.

At the tail part 30T of the sonde 30, that is, the opening to junction the steel pipe 11, the sonde 30 has a pulse valve 33 to limit the flow rate of the muddy water and a hook 34 projected toward the ground. The pulse valve 33 is a part of the so-called positive mud pulse generator to send various data toward the ground by the changes of pressure of the muddy water caused by opening or shutting of the valve.

The hook 34 is provided to hook the end of the wire suspended from the ground. When the wire whose end is hooked by the hook 34 is winched up, the sonde 30 is separated from the connecting pipe 20, being raised inside the digging pipes 12 and is finally withdrawn on the ground.

Figure 3:
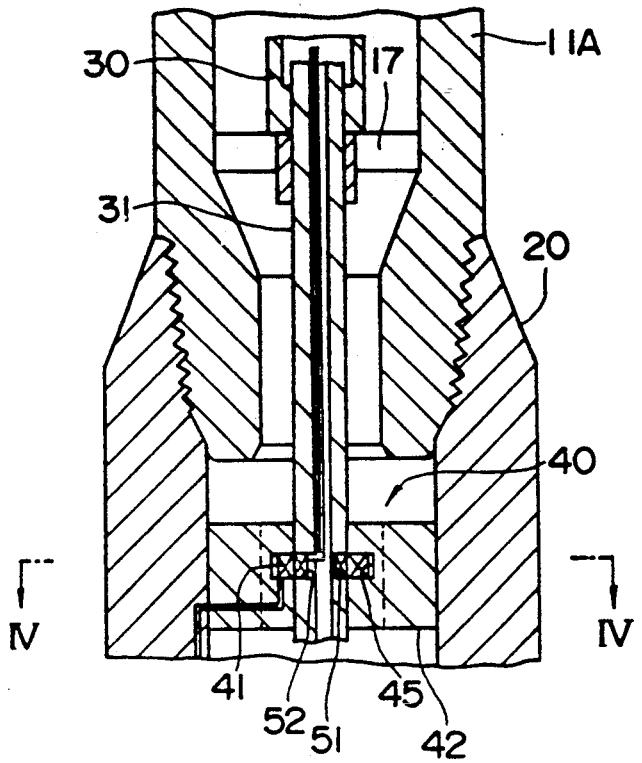
FIG. 3 is a sectional view which shows enlarged connecting condition of the main parts of the embodiment.
Figure 4:
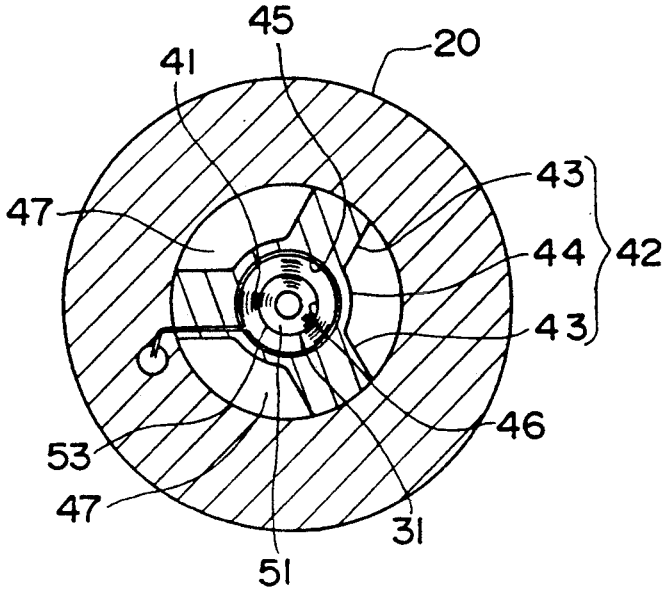
FIG. 4 is a sectional view which shows FIG. 3 broken along the IV—IV line.
Figure 5:
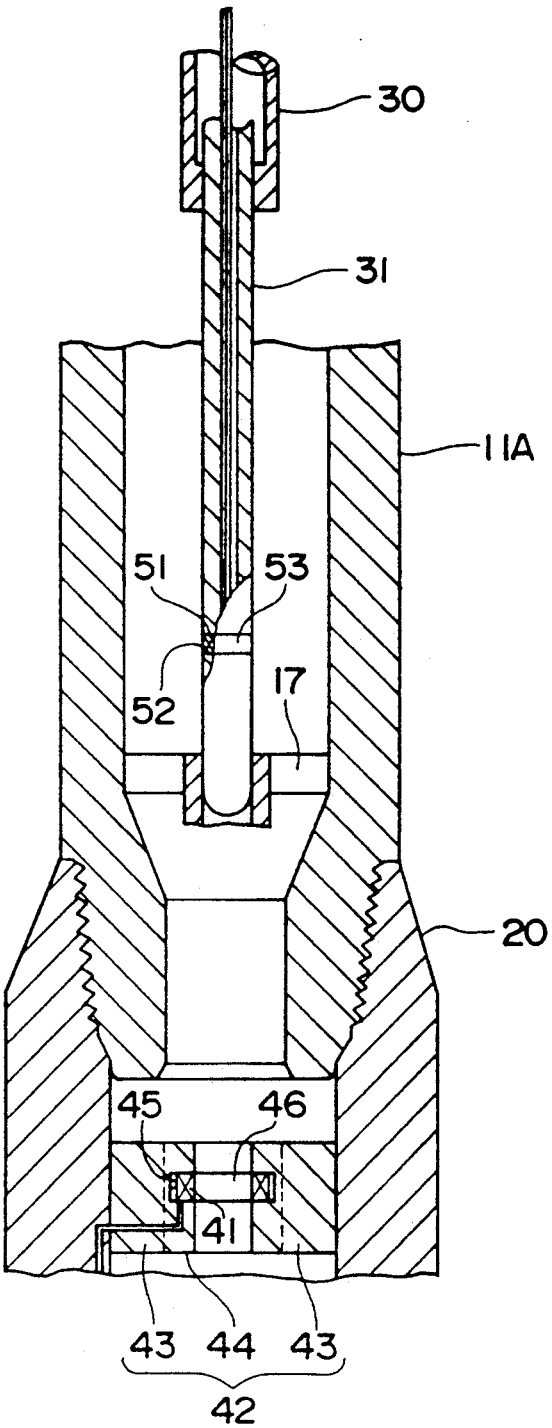
FIG. 5 is a sectional view which shows enlarged separating condition of the main parts of the embodiment.

In FIGS. 3–5, an electromagnetic coupler 40 is shown to connect the connecting pipe 20 and the sonde 30 electrically. The coupler 40 contains a primary coil 41 mounted in the connecting pipe 20 and the secondary coil 51 mounted to the sonde 30. The primary coil 41 has a ring-like shape which enables the shaft 31 of the sonde 30 to be inserted thereinto and is provided inside a supporting member 42 fixed near an end of the connecting pipe 20. The supporting member 42 has more than one arms 43 which are radially extended and forms a ring-like part 44 whose inner diameter is almost the same as that of the primary coil 41 at the center. The ring-like part 44 is formed with a groove 45 into which the primary coil 41 is attached. The opening surface of the groove 45 is stopped up with a lid member 46 made of non-magnetism material such as aluminum or synthetic resin with heat resistance, whereby the groove 45 is in the condition of being sealed up. There is a passage 47 where the muddy water flows between the ring-like part 44 and the inner circumference of the connecting pipe 20.

The secondary coil 51 is a ring-like coil with the outside diameter almost the same as that of the shaft 31 of the sonde 30 and it is attached to a groove 52 which goes around the outer circumference of the shaft 31. The groove 52 is formed at the position of facing the primary coil 41 mounted in the connecting pipe 20 and consequently, when the sonde 30 is connected to the connecting pipe 20, the secondary coil 51 is positioned inside the primary coil 41. Incidentally, the opening part of the groove 52 is sealed by using a lid member 53 made of aluminum or non-magnetism matter such as synthetic resin with heat resistance as well as the groove 45.

Figure 6:
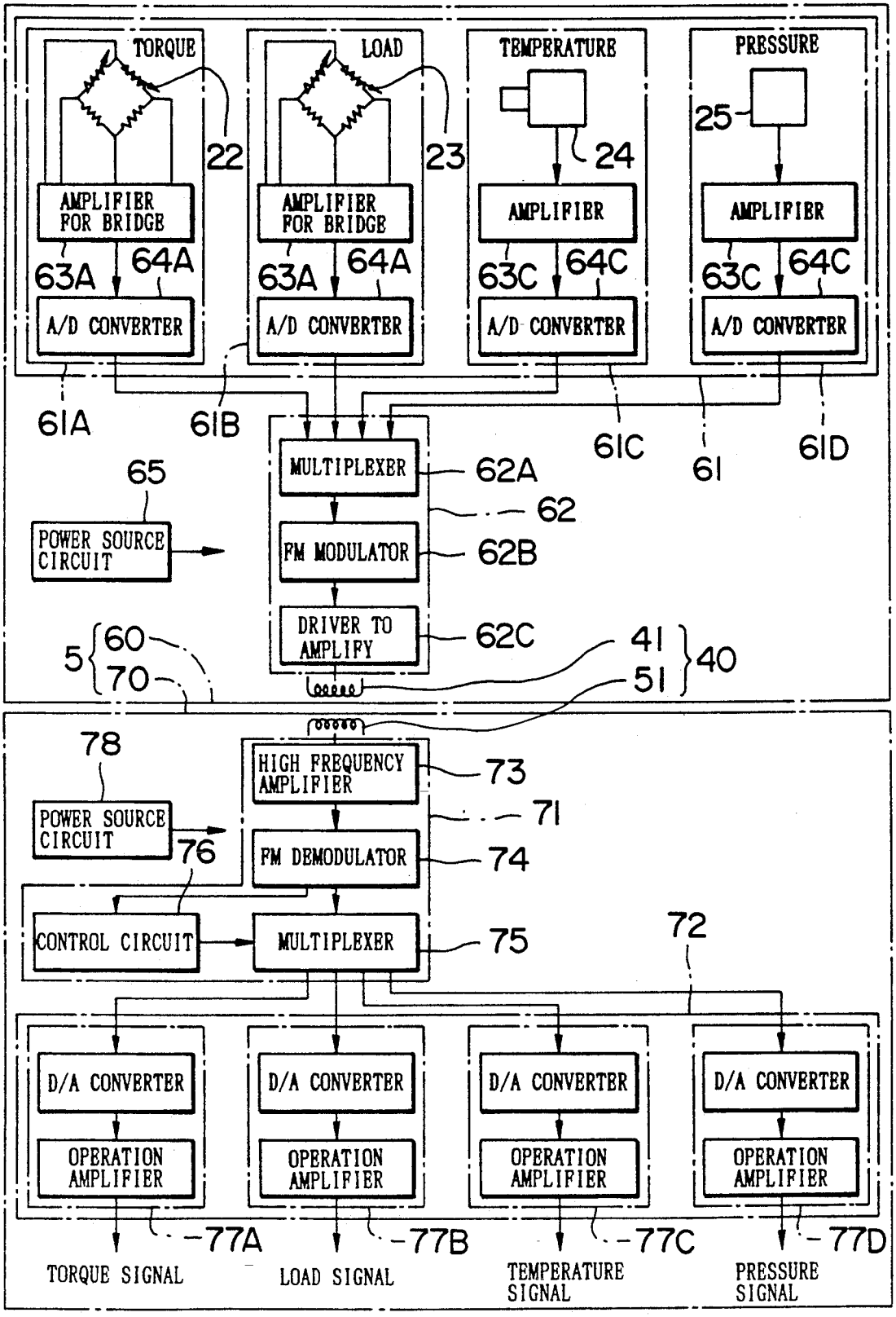
FIG. 6 is a diagram which shows the structure of the electric circuit for the bottom-hole information collecting equipment based on the embodiment.

In FIG. 6, the main structure of an electric circuit 5 for the bottom-hole information collecting equipment is shown.

The electric circuit 5 comprises a transmission circuit 60 mounted inside of the connecting pipe 20 and a receiving circuit 70 mounted in the sonde 30. Each circuit is electrically connected by the above explained electromagnetic coupler 40. The transmission circuit 60 is equipped with a signal processing portion 61 to convert the respective analog signals gotten in the sensors 22-25 into digital signals after being amplified, and a multiplexing portion 62 to send these digitalized signals putting on the carrier with high frequency to the receiving circuit 70 after multiplying the signals. Converters 61A-61D to convert the analog signals from each sensor into digital signals after amplifying them are equipped with the signal processing portion 61 at every sensor 22-25. First, the converter 61A is prepared for the torque sensor 22, wherein it has an amplifier 63A for the bridge to amplify the signals from the torque sensor 22 and an A/D converter 64A to convert the signals gotten in the above-mentioned way into digital signals. The converter 61B is prepared for the bit load sensor 23 and has an amplifier for the bridge and an A/D converter as well as the converter 61A. Next, the converter 61C is prepared for the temperature sensor 24 and has an amplifier 63C to amplify signals from the temperature sensor 24 and an A/D converter 64C to convert analog signals into digital. The converter 61D is provided for the pressure sensor 25 and has an amplifier and an A/D converter like the converter 61C.

The multiplexing portion 62 multiplexes the digital signals output from the above-mentioned more than one converter 61A-61D in the time-division system. The multiplexing portion 62 has a multiplexer 62A which selects one from the various output from the converters 61A-61D at the fixed cycle and then sends the thus-output with signals for control, a FM modulator 62B which modulates the frequency of the output from the multiplexer 62A, and a driver 62C to amplify the weak signals output from the FM modulator 62B to be strong enough to be transmitted via the electromagnetic coupler 40. Besides, a power source circuit 65 electrically connected to the generator 29 is contained in the transmission circuit 60.

The receiving circuit 70 is provided to make more than one data signals multiplexed into separate analog signals again. The receiving circuit 70 has a signal resolving portion 71 to resolve the signals multiplexed in the transmission circuit 60 into the data signals for each sensor 22-25 and an inverter portion 72 to make digital signals into analog signals again.

The signal resolving portion 71 has a high frequency amplifier 73 to amplify the signals received by the electromagnetic coupler 40, a FM demodulator 74 to demodulate the signals modulated in the transmission circuit 60 and to separate the data signals and the control signals, a multiplexer 75 to divide more than one multiplexed data signals to each output, and a control circuit 76 to synthesize the multiplexer 75 with the multiplexer 62A in the transmission circuit 60 by receiving the control signals from the FM demodulator 74.

The inverter portion 72 comprises the converters 77A-77D in correspondence to each sensor 22-25. Each converter 77A-77D is provided to convert the digital signals resolved in the multiplexer 55 into analog signals. Each of the converters 77A-77D comprises a D/A converter and the operation amplifier and so on. The analog data signals output from each converter 77A-77D are input to a mud pulse transmission equipment which is not shown in drawings. Besides, a power source circuit 78 connected to the generator 29 is also provided with the receiving circuit 70 like the above-mentioned transmission circuit 60.

Therefore, in the present embodiment, when the sonde 30 is thrown into the inside of the digging pipes 12, the sonde 30 is connected mechanically to the connecting pipe 20, whereby the sonde 30 and the sensors 22-25 are electrically connected. Under this condition, the sonde 30 collects the torque given to the bit 13, the data of load and so on during the excavation and it sends them every time it collects them. On the ground, transmitted data is surveyed by the data processing equipment 4. Also, when the temperature at the bottom of the shaft 1 abnormally exceeds the limit heat resistance temperature of the sonde 30 and there is a fear of damaging the sonde 30, the sonde 30 can be prevented from being damaged by heat by means of collecting it to the ground by separating the sonde 30 from the connecting pipe 20.

In the above-mentioned embodiment, effects mentioned below can be expected. Since the connecting pipe 20 is electrically connected to the sonde 30 through the electromagnetic coupler 40, even if both the primary coil 41 and the secondary coil 51 of the electromagnetic coupler 40 are sealed, the electric connection can be conducted without touching each other, whereby as long as the connection between the sonde 30 and the connecting pipe 20 is maintained, the torque and the data such as load gotten in the sensor 22 and 23 are collected in real time. Also, when the sonde 30 is likely to be influenced by the muddy water with high temperature and the high pressure, it can safely separated from the connecting pipe 20.

Because the collecting work of the sonde 30 toward the ground can be done using the hook 34 mounted in the tail part 30T, the sonde 30 can be used repeatedly without being thrown away after use.

Moreover, because the sonde 30 is equipped with the centralizer 32, when the sonde 30 has only to fall freely, it is aligned with the central axis of the connecting pipe 20 an moreover, it can be connected mechanically, wherein the primary coil 41 and the secondary coil 51 of the electromagnetic coupler 40 are connected. That is, the sonde 30 arbitrarily and easily achieves the mechanical and electrical connection to the connecting pipe 20.

Also, because the turbine blades 27 and 28 are provided inside the connecting pipe 20 and because electricity is generated both in the connecting pipe 20 and the sonde 30, the connecting pipe 20 and the sonde 30 can get electricity just by the flow of the muddy water. Unlike the bottom-hole information collecting equipment of battery type, since there is no fear of running out of batteries, the sonde 30 can be left at the bottom part of shaft 1 for a long time.

Moreover, because the signals received and sent in the electromagnetic coupler 40 are digital signals modulated into FM, the signals received by the sonde 30 has very little noise. Therefore, correct data can be collected in the sonde 30.

Besides, the present invention is not limited to the above-mentioned embodiment but it includes modifications mentioned below.

The bottom-hole information collecting equipment 2 can be provided with other sensors than the sensors 22–25 which have been explained such as the azimuth sensor and the stratum ratio resistance sensor. And then, it doesn't matter that the components unnecessary to be mounted in the connecting pipe 20 are mounted in the sonde 30. The number, type, and the mounting position of the sensors provided with the bottom-hole information collecting equipment 2 of the present invention are not limited to those of the above-mentioned embodiment.

Also, the shape of the two turbine blades 27 and 28 are not limited to the screw for a boat shown in the said embodiment and many turbine blades like the turbine of the jet engine can be provided, for example. The shape and the model of the turbine aren't limited to the above mentioned execution example.

Moreover, the power supplier of the bottom-hole information collecting equipment is not limited to the generator; it can be a battery, wherein though the sonde 30 cannot be expected to be left at the bottom part of the shaft 1 for a long time, since the mechanism for the generator is not needed, the whole structure of the equipment can be simplified. The structure of the electromagnetic coupler 40 is not limited to that with one ring-like coil arranged on the same axis inside the other ring-like coil and for example, it can have a structure in which a pair of coils are arranged to be piled up with the central axis aligned, that is, it should have a structure where the non-touch electric connection is possible using the electromagnetism.

Moreover, the communication method from the sonde 30 to the data processing equipment 4 on the ground is not limited to the mud pulse method using the pulse valve 33 and for example, it can be a sound method using a sound radiator which can send supersonic waves or a radio method using electromagnetic waves, that is, concrete communication method can be selected properly on the occasion of the practice.

As is mentioned above, in the present invention, the data of the digging pipes can be collected in real time and the sonde is connected or separated arbitrarily.

What is claimed is:

1. An information collecting apparatus for collecting a plurality of drilling data signals from a bottom of an earthen shaft being drilled excavating equipment including a plurality of hollow digging pipes coupled end to end, a rotatable drilling bit which scrapes away earthen rock and sand to form said shaft, and a connecting pipe for coupling said drilling bit to a first pipe of said plurality of drilling pipes, said drilling bit discharging a muddy water from a free end thereof, said muddy water being transported to said drilling bit from within said plurality of digging pipes and said connecting pipe, said information collecting apparatus comprising:

a sonde disposed within said first pipe and having a first end thereof being mechanically engageable with said connecting pipe;

a plurality of sensors provided in said connecting pipe, each said sensor collecting one of said plurality of data signals from said bottom of the shaft; and means for coupling said plurality of sensors to said sonde.

2. The information collecting apparatus according to claim 1, wherein said sonde includes means for aligning said sonde with a central axis of the digging pipes.

3. The information collecting apparatus according to claim 2, wherein said means for aligning includes a centralizer having a plurality of bowed plate springs connected to said sonde, each said plate spring extending along said central axis and having an intermediate portion thereof contacting an inner surface of said digging pipes.

4. The information collecting apparatus according to claim 1, wherein said sonde includes a hook disposed at a second end thereof to permit said sonde from being removed from within said digging pipes.

5. The information collecting apparatus according to claim 1, wherein said sonde includes a pulse valve to change a current pressure of the muddy water fed into the digging pipes.

6. The information collecting apparatus according to claim 1, wherein said sonde includes a generator disposed within said first end thereof, said connecting pipe includes a turbine blade driven by said muddy water passing therethrough and which drives said generator by a shaft which extends from said sonde into said connecting pipe.

7. The information collecting apparatus according to claim 6, wherein said sensors are connected to a second generator which is driven by a second turbine blade also rotated by the muddy water.

8. The information collecting apparatus according to claim 1, wherein said means for coupling includes a primary coil disposed within said connecting pipe and a secondary coil located on said sonde.

9. The information collecting apparatus according to claim 8, wherein said secondary coil is rotatable.

10. The information collecting apparatus according to claim 8, wherein said primary coil has a first electrical circuit coupled thereto, said first electrical circuit including a signal processing portion to convert said plurality of data signals from analog signals to digital signals and a multiplexing portion to multiplex said digital signals and subsequently modulate said multiplexed signals with a high frequency carrier signal, and wherein said secondary coil has a second electrical circuit coupled thereto, said second electrical circuit including a signal resolving portion to resolve said multiplexed signals back into said digital signals and an inverter portion to convert said digital signals back into said analog signals.

11. The information collecting apparatus according to claim 8, wherein said primary and secondary coils are individually sealed so as not to directly contact to each other.

* * * * *

UNITED STATES PATENT AND TRADEMARK OFFICE

CERTIFICATE OF CORRECTION

PATENT NO. : 5,295,548

DATED : March 22, 1994

INVENTOR(S) : Hajime YUASA et al.

It is certified that error appears in the above-identified patent and that said Letters Patent is hereby corrected as shown below:

Column 7, line 60; after "drilled" insert ---by---.

Signed and Sealed this

Ninth Day of August, 1994

*Attest:*

*Attesting Officer*

Bruce Lehman

BRUCE LEHMAN

*Commissioner of Patents and Trademarks*